US006860281B1

(12) United States Patent
Clift

(10) Patent No.: US 6,860,281 B1
(45) Date of Patent: Mar. 1, 2005

(54) SITTING AND STANDING ASSIST APPARATUS

(76) Inventor: Dwight H. Clift, P.O Box 482, Pinehurst, ID (US) 83850

( * ) Notice: Subject to any disclaimer, the term of this patent is extended or adjusted under 35 U.S.C. 154(b) by 21 days.

(21) Appl. No.: 10/160,302

(22) Filed: May 31, 2002

(51) Int. Cl.[7] ..... A61H 3/00

(52) U.S. Cl. ..... 135/67; 135/66; 5/81.1 R; 5/662; 297/411.23; 297/6

(58) Field of Search ..... 135/65–67, 75; 297/411.23, 5–6, 423.2, DIG. 10; 5/85.1, 86.1, 81.1 R, 662, 503.1, 659; 482/66–69; 4/578.1, 480

(56) References Cited

U.S. PATENT DOCUMENTS

| | | | | | |
|---|---|---|---|---|---|
| 1,890,102 | A | | 12/1932 | Urquhart | |
| 2,592,702 | A | | 4/1952 | Sprung | |
| 3,272,530 | A | * | 9/1966 | Klassen | 280/79.2 |
| 3,739,793 | A | * | 6/1973 | Wilson | 5/503.1 |
| 4,314,576 | A | * | 2/1982 | McGee | 135/67 |
| 4,844,107 | A | | 7/1989 | Watkins | |
| 4,932,090 | A | * | 6/1990 | Johansson | 5/662 |
| 5,226,439 | A | | 7/1993 | O'Keeffe et al. | |
| 5,397,169 | A | * | 3/1995 | Willans | 297/411.23 |
| 5,449,013 | A | | 9/1995 | Landers | |
| 5,465,744 | A | | 11/1995 | Browning | |
| 5,509,432 | A | | 4/1996 | Peterson | |
| 5,560,053 | A | * | 10/1996 | Mills | 5/81.1 R |
| 5,904,168 | A | * | 5/1999 | Alulyan | 135/65 |
| 5,983,911 | A | | 11/1999 | Steele | |
| 6,244,285 | B1 | | 6/2001 | Gamache | |
| 6,332,232 | B1 | * | 12/2001 | Neal | 5/662 |

* cited by examiner

*Primary Examiner*—Winnie Yip
(74) *Attorney, Agent, or Firm*—Wells St. John, P.S.

(57) ABSTRACT

A sitting and standing assisting apparatus is described in which a platform has a front edge and opposed side edges joined to the front edge. An assist frame is mounted to the platform with an upright leg part adjacent each side edge. The upright leg parts are spaced forwardly of the front edge. The upright leg parts include upper ends with hand grips that are elevationally adjustable. The assist frames are adjustable toward and away from the side edges.

14 Claims, 7 Drawing Sheets

SITTING AND STANDING ASSIST APPARATUS

CROSS REFERENCE TO RELATED APPLICATION

This application is an original U.S. Patent Application.

TECHNICAL FIELD

The present invention relates to seating and standing assisting apparatuses.

BACKGROUND OF THE INVENTION

Elderly and physically infirm people often have difficulty sitting a and rising from chairs or other related user support furniture without in assistance. Many such individuals could sit or arise without assistance if they could use their arm strength to supplement their legs. However, many chairs or related user support furniture do not have armrests or handholds that can be readily used for such purposes.

A need has been recognized for apparatus that may be used by individuals to make use of arm strength for seating and rising functions. Various apparatus have been developed to this end, but have not been suited for relatively wide application for different forms of user supports. For example, many include forwardly projecting horizontal members that rest against the floor and project forwardly of the user support. Such forward projections create a trip hazard. Others are not fully adjustable to accommodate user support of different size or structure.

Thus a need has remained for an improved assist apparatus that will facilitate positioning of a chair or other seating furniture and provide hand grips that may be adjusted to a desired elevation to maximize the use of arm strength in seating and arising functions.

The present invention is intended for use in conjunction with various forms of user supports, which should be understood in a broad context to include but not be limited to arm chairs, recliners, kitchen chairs, stools, love seats, and other seating or support structures such as beds.

BRIEF DESCRIPTION OF THE DRAWINGS

Preferred embodiments of the invention are described below with reference to the following accompanying drawings.

FIGS. 7, 8 and 9 are views illustrating use of the apparatus with examples of user support structures;

DETAILED DESCRIPTION OF THE PREFERRED EMBODIMENTS

Figure 1:
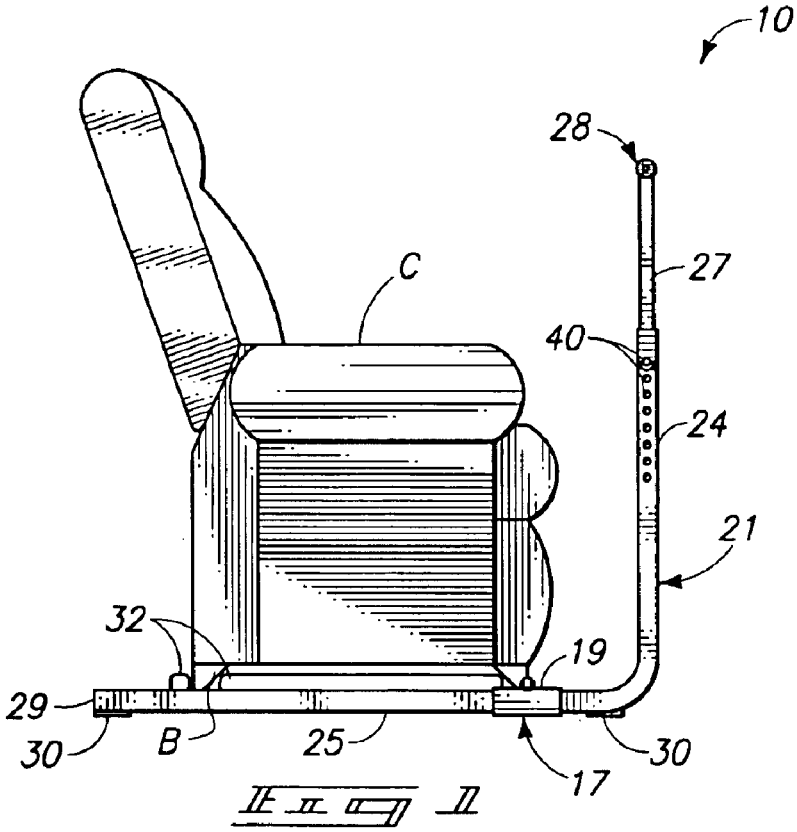
FIG. 1 is a side elevation view of a chair as a user support and a preferred access assisting device.

This disclosure of the invention is submitted in furtherance of the constitutional purposes of the U.S. Patent Laws "to promote the progress of science and useful arts" (Article 1, Section 8).

Before describing preferred details of the present apparatus, general aspects will first be discussed. Exemplary forms of the apparatus are intended for use with a user support such as a chair, stool, sofa, bed or other similar structures.

In a first aspect, a preferred sitting and standing assisting apparatus 10 includes a platform 12 having a user support receiving surface 13, a front edge 14 and opposed side edges 15, 16 joined to the front edge 14. A cross bar 17 is mounted to the platform 12 adjacent to the front edge 14 and extends to ends 18, 19 adjacent to the side edges. "L" shaped assist frames 20, 21 are mounted to the cross bar 17. Each "L" shaped assist frame 20, 21 includes an upright leg part 24 adjacent the cross bar 17, and a rearwardly extending brace part 25 spaced outwardly of and extending along one of the side edges 15, 16. The cross bar 17 is adjustable to selectively space the assist frames 20, 21 apart from the platform side edges 15, 16. The upright leg parts 24 extend to upper ends 27 that include hand grips 28. The platform 12 is configured to receive a user support base B with the assist frames 20, 21 positioned to opposite sides of the user support, such as a chair C and the hand grips 28 positioned to be grasped and acted against by a user seeking to sit or arise from the chair C.

In another aspect, the sitting and standing assisting apparatus 10 includes a platform 12 having a front edge 14 and opposed side edges 15, 16 joined to the front edge 14. Assist frames 20, 21 are mounted to the platform 12 with upright leg parts 24 adjacent each side edge 15, 16. The upright leg parts 24 are spaced forwardly of the front edge 14 and each upright leg part 24 includes an upper end 27 with a hand grip 28. The hand grips 28 are elevationally adjustable, as are the assist frames 20, 21 adjustable toward and away from the side edges 15, 16.

A further aspect includes the sitting and standing assisting apparatus with a platform 12 having an upwardly facing user support receiving surface 13, a front edge 14 and opposed side edges 15, 16 leading rearwardly from the front edge 14. Chair engaging cleats 32 are adjustably positioned on the user support receiving surface 13. An adjustable cross-bar 17 is mounted to the front edge 14 and extends to ends 18, 19 that are spaced outwardly of the side edges 15, 16. The cross bar 17 is adjustable with respect to the platform 12 such that the cross bar ends 18, 19 may be selectively positioned toward and away from the side edges 15, 16. "L" shaped assist frames 20, 21, each having a horizontal brace part 25 and an upright leg part 24 extending to an upper end 27 including a hand grip 28. The horizontal brace parts 25 are attached to the cross bar ends 18, 19 and extend along the platform side edges 15, 16 rearwardly of the front edge 14. The horizontal brace parts 25 are adjustably positionable on the cross bar ends 1B, 19 to permit selective forward and rearward positioning of the upright leg parts 24 with respect to the front edge 14 of the platform 12. The upright legs 24 are adjustable to allow selective elevational positioning of the hand grips 28.

Figure 6:
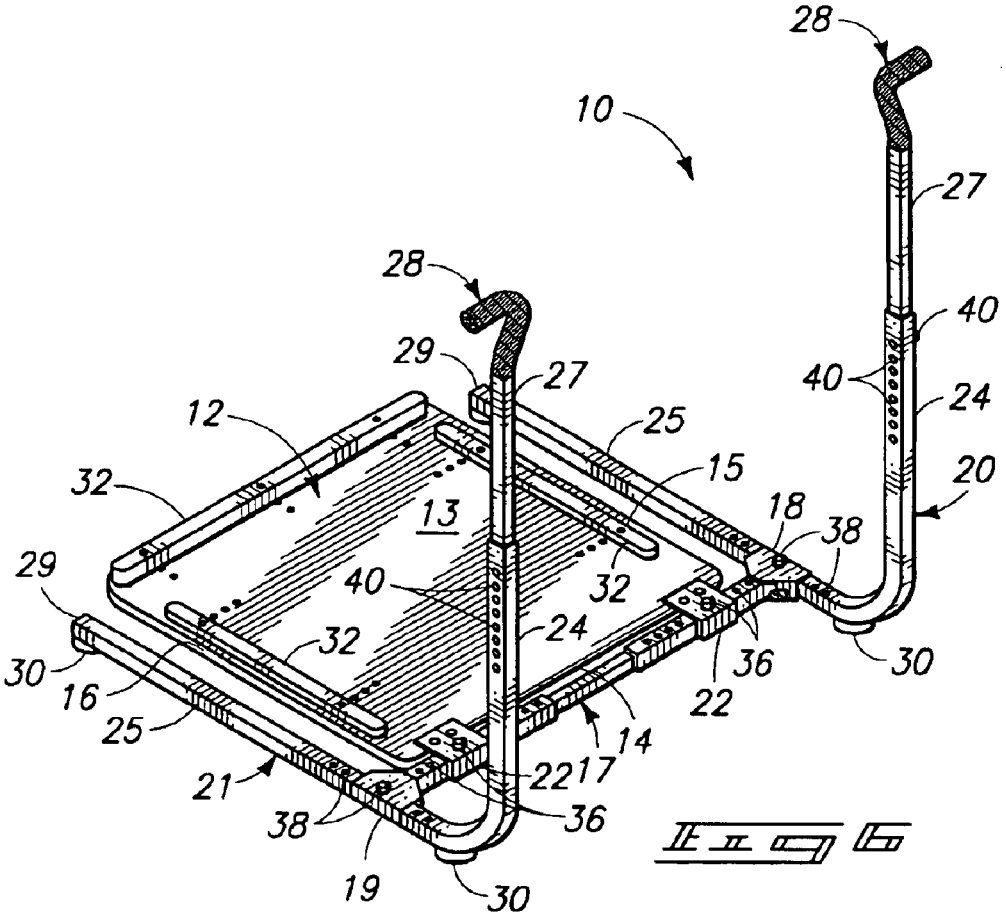
FIG. 6 is a perspective view of the assisting apparatus.

Referring now in greater detail to the drawings and preferred elements of the present invention, reference is first made to FIG. 6 where the preferred apparatus 10 is illustrated in a perspective view. There, the platform 12 is illustrated as being of a flat, rectangular form. The platform may be of a size selected to accommodate different forms of chair configurations such that the base B of the user support will be supported on the receiving surface 13. The cleats 32 may be utilized to engage the user support base B to prevent sliding of the user support relative to the platform. Adjustments are provided to permit selective positioning of the cleats for this purpose.

The platform may be constructed of a conventional rigid material such as plywood, composition, or other appropriate relatively thin but rigid material. The size of the platform may be determined by intended use but may be made for a wide variety of user support structures. For example, the platform shown in FIGS. 1–8 is intended for use with a chair, but may also be used alternatively as illustrated in FIG. 9.

In preferred forms, the front edge 14 of the platform 12 is mounted to the crossbar 17 of the apparatus. The front edge mounting arrangement for the crossbar permits adjustment of the crossbar ends 18, 19 toward and away from the adjacent side edges 15, 16 of the platform. Such adjustment is graphically indicated by comparing FIGS. 3 and 4. To accomplish the connection, brackets 22 (FIGS. 3, 4, 11, 12) are secured between the crossbar 17 and platform adjacent the platform side edges 15 and 16. Further, the crossbar 17 is provided in a telescoping fashion with adjusting holes along length of the interfitting telescoping members to facilitate length adjustment of the crossbar. Conventional pins, screws, or other fixing or clamping arrangements may be provided to selectively lock the telescoping sections of the crossbar 17 and brackets 22 together to secure the crossbar ends 18, 19 at the selected adjusted positions. This may be done to accommodate chairs or users of various size while the platform 12 remains centrally situated between the assist frames 20, 21.

Figure 2:
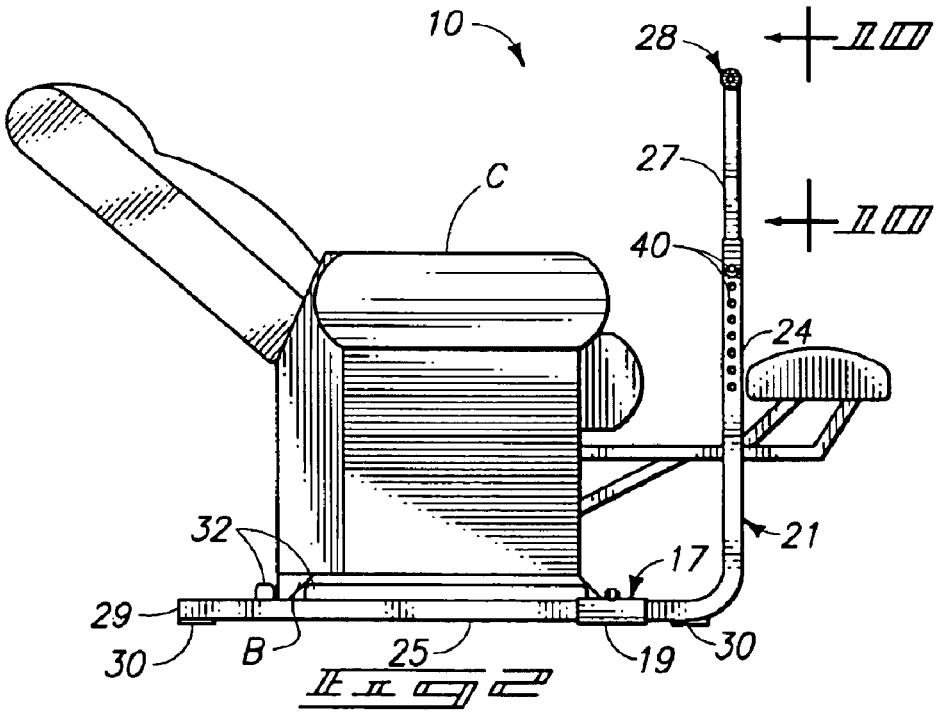
FIG. 2 is a side elevation view of the chair in a reclining position and the relative position of the access assist.
Figure 3:
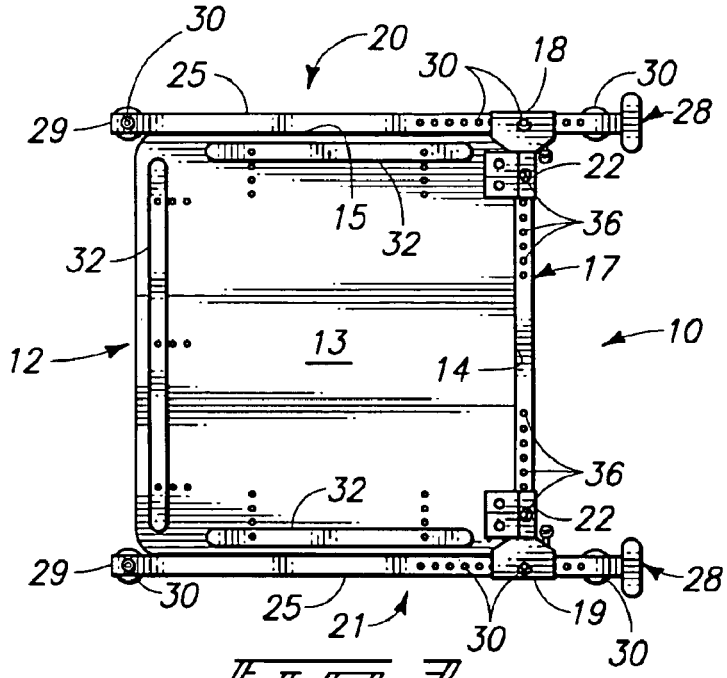
FIG. 3 is a top plan view of the preferred device.
Figure 4:
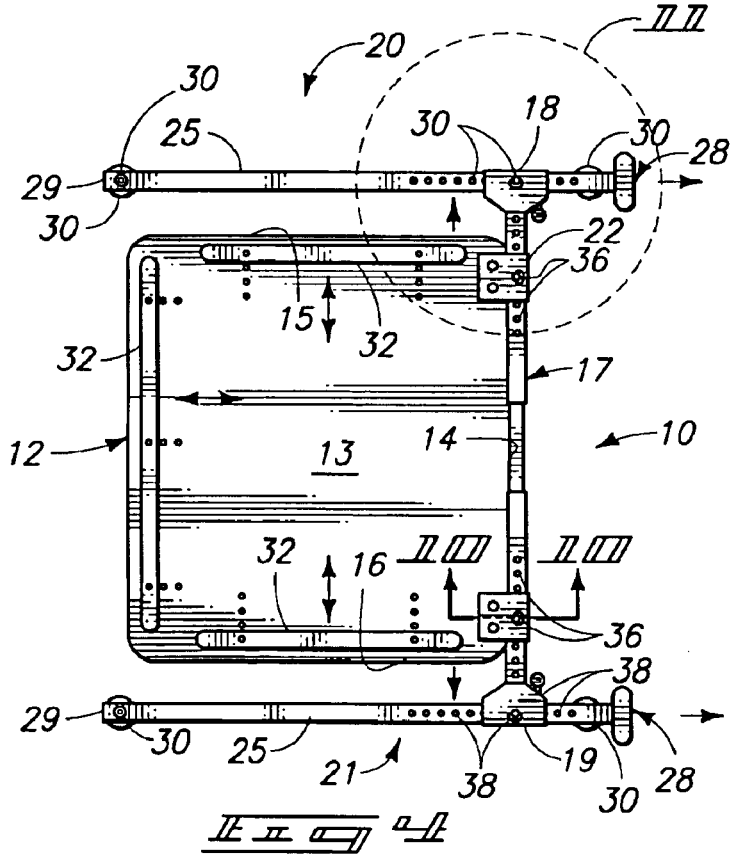
FIG. 4 is a view similar to FIG. 3 only showing assist frames adjusted outwardly from the positions shown in FIG. 3.
Figure 5:
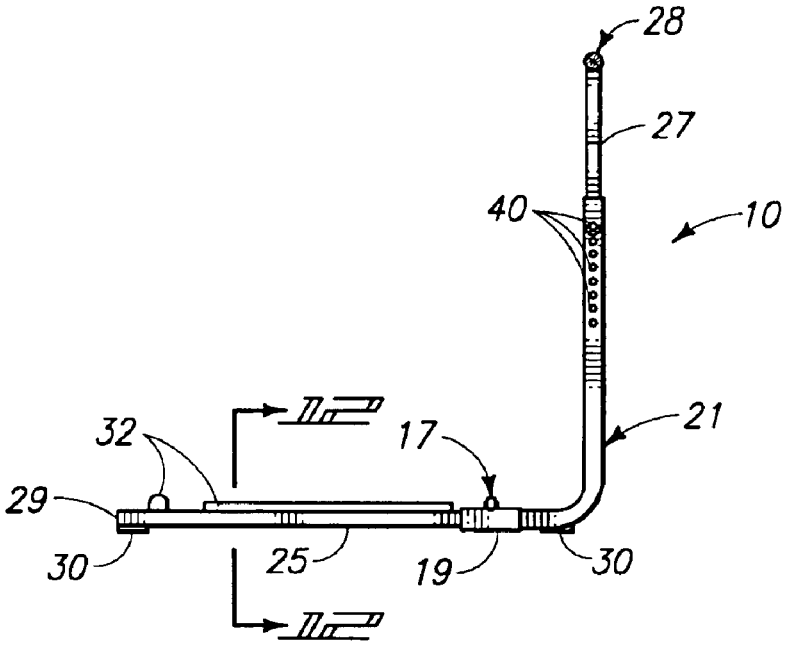
FIG. 5 is a side elevation view of the assisting apparatus alone.

The above adjustments are especially convenient when the apparatus is used in conjunction with a recliner chair as indicated in FIG. 2. The assist frames as illustrated, may be positioned to opposite sides of the footrest portion of the chair to allow movement of the chair to the illustrated FIG. 2 reclining position. Furthermore, this adjustment will accommodate other forms of user supports such as a swivel chair in order to permit normal operation of the chair as desired by the user. Still further use of the apparatus may be made in conjunction with other user supports, such as the bed shown in FIG. 9.

The assist frames 20, 21 may be mirror images of one another and otherwise include substantially identical components. Like reference numerals will therefore be used to identify similar elements of both frames.

As discussed above, the preferred frames 20, 21 are "L" shaped in which the brace parts 25 meet the upright leg parts 24 at a junction such that no portion of the brace parts 25 project forwardly of the leg parts. This eliminates the possibility of a portion projecting forward and presenting, a tripping hazard to the user. Instead, as illustrated, the brace and leg parts 25, 24 may be integrally formed and bent at the junction to a provide a smooth, curved transition between the horizontal and upright components.

It may be desirable to form the horizontal brace parts 25 and in at least portions of the upright leg parts 24 from single lengths of rigid material such as steel or aluminum channel. The horizontal extent of the brace parts are selected to span the adjacent extent of the platform such that rearward ends 29 of the brace parts may project rearwardly of the platform while the junction and upright leg parts 24 extend forwardly of the front platform edge 14. This increased length facilitates forward and rearward adjustment with respect to the platform 12 while providing a bracing function against forces applied by a user grasping and applying forces against the hand grips 28 during seating and arising functions.

FIG. 9 shows an embodiment with an extended adjustment of the platform to further increase the length dimension of the brace parts to facilitate use of the apparatus under beds or similar user supports. Further stability may be gained in such applications by placing weights on the extended platform 12, especially in situations where the weight of the user support cannot be brought to bear on the platform. As an example, sand bags are shown in FIG. 9 to add stability where the bed frame cannot be conveniently brought to bear on the platform R.

Pads 30 may be provided along the brace parts 25 in spaced relation to engage against a floor or other support surface. The pads may be formed of a plastic, rubber, or other high friction material that will discourage slipping of the apparatus on a support surface. The pads may also be used to prevent scratching or marking of the support-surface by the brace parts 25 and brackets 22.

It is also preferred that the pads 30 be placed slightly inward of the ends 30 and the junction between the braces and upright leg parts to avoid any projection that could create a tripping hazard. As exemplified in FIGS. 3 and 4, four of the pad members are preferably used, two on each assist frame 20, 21. One or more pads may also be used on the brace extensions 50.

As illustrated in FIGS. 3, 4, 6, 11 and 13, the crossbar ends 18 are most preferably configured to adjustably receive the brace parts 25 of the respective assist frames. Adjustment features may be provided in the form of adjustment holes provided in the brace parts to co-act with locking pin or clamp arrangements provided on the crossbar ends. Such arrangements may be utilized to selectively position the upright leg parts 24 and hand grips 28 toward or away from the front platform edge 14. Alternative clamp devices (FIG. 13) may also be used to permit selective positioning of the hand grips and upright members with respect to the platform to accommodate different forms of chair configurations.

The above adjustments also facilitate positioning to accommodate individual needs of the user. For example, a user having long arms may wish to have the upright leg parts 24 spaced further forward of the platform 1;2 and user support received thereon; whereas a user having short arms may wish to have the hand grips 28 positioned closer to the platform 12 and user support.

It is noted that the positioning for the assist frames 20 and 21 may be accomplished independently if so desired, but all adjustments may be accomplished without affecting the relative position of the platform 12 which may remain in position beneath the associated user support.

Preferred forms of the upright leg parts 24 are adjustable to accommodate elevational adjustment of the hand grips 28. To accommodate such adjustment, portions of the upright leg parts may be interfitted in telescoping fashion with appropriate adjustment openings or clamp arrangements that will facilitate relative elevational adjustment of the hand grips. In the illustrated example, a series of spaced holes are provided to interact with a pin and matching holes (not shown) provided in the telescoping part. Of course, other forms of adjusting mechanisms including clamps, detents, ratchet mechanisms and the like may be used to accomplish elevational adjustment. Such adjustment may be accomplished to accommodate physical characteristics and capabilities of the user. It is again pointed out that each of the adjustments may be accomplished independently if so desired.

Figure 10:
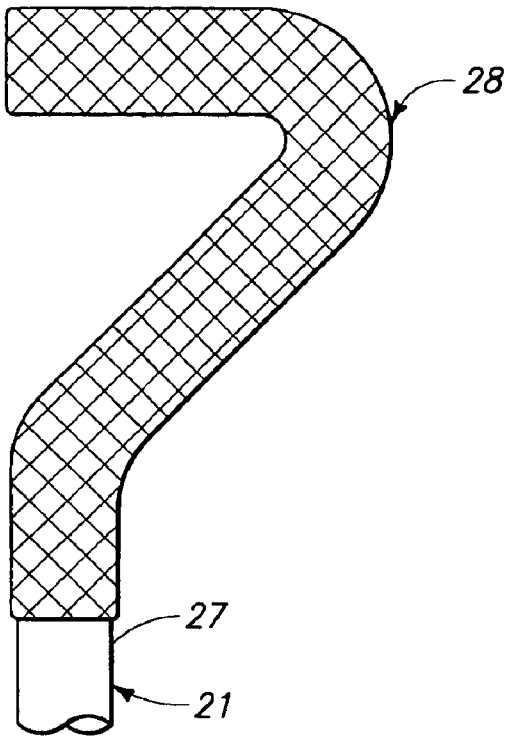
FIG. 10 is an enlarged fragmentary view of an area identified at 10—10 in FIG. 2.
Figure 11:
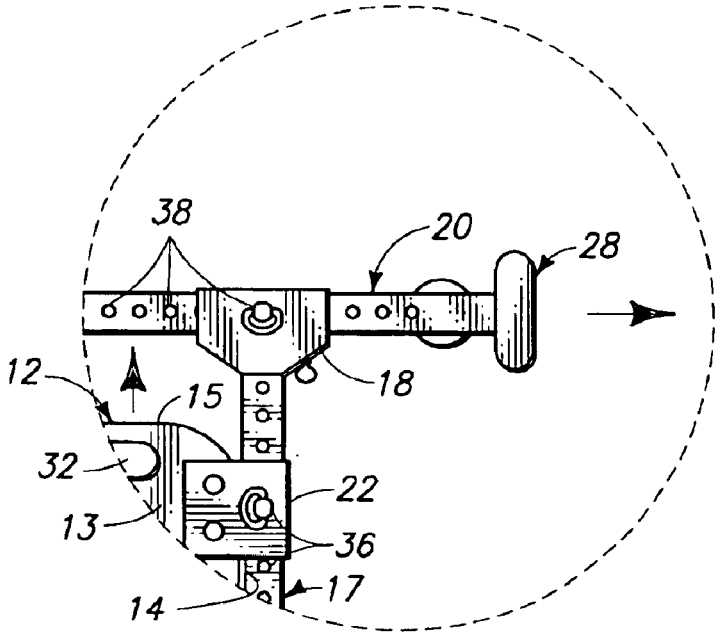
FIG. 11 is an enlarged fragmentary view of an area identified at 11 in FIG. 4 and further showing outward adjustment of a handle part.
Figure 12:
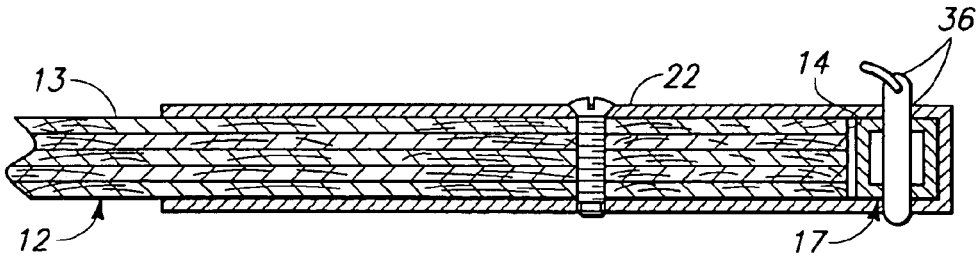
FIG. 12 is an enlarged sectional view taken substantially along line 12—12 in FIG. 4.
Figure 13:
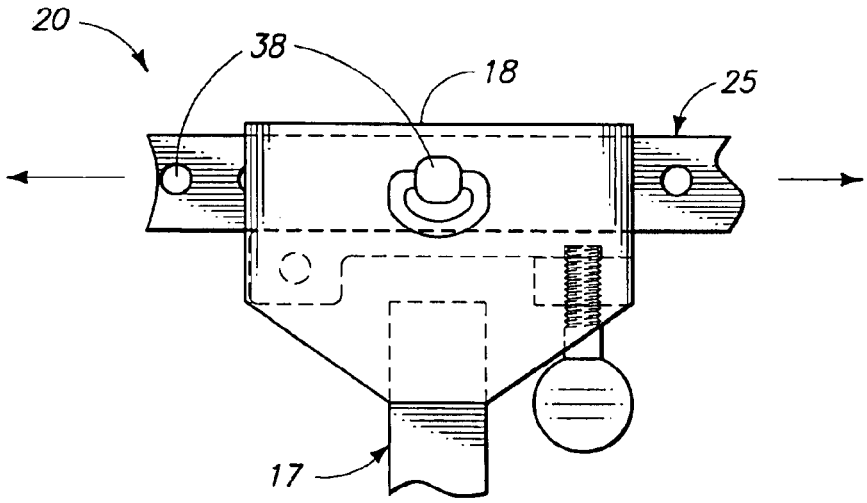
FIG. 13 is an enlarged fragmented view of an exemplary adjustment provision.

In preferred forms, the hand grips 28 are formed integrally with the upright leg parts 24. The grips may be formed by bending upward ends of the leg parts 24 into the exemplary angular orientations (FIG. 10). Preferably, the handgrips 28 are bent outwardly with respect to the platform and as illustrated in FIG. 6.

The outward bent handgrip configurations are advantageous in that the handgrip ends are positioned away from the user and are not 14 likely to catch on clothing. Further, the handgrips are preferably provided with a coating or gripping surface that extends partly down the leg parts 24 to offer a choice to the user of gripping the horizontal portions or the downwardly adjacent vertical parts.

It is preferred that the gripping surface be a soft, high friction material such as an appropriate foam synthetic rubber material. Such material may be applied as a coating on the hand grips or may be mechanically secured.

Operation of the present apparatus may begin by adjusting the apparatus to the appropriate user support and user. In doing so, it is advisable to either measure the support base or position the apparatus in relation to the support in order to facilitate adjustments of the assist frames 20, and 21 to positions accommodating the support with or the physical stature of the individual to be using the apparatus.

Adjustment of the assist frames 20, 21 together or apart from one another may be easily accomplished by use of the appropriate clamping or adjusting pin and hole arrangements as illustrated to allow the crossbar to be extended or retracted. Such adjustment facilitates movement of the crossbar ends 18, 19 toward or away from one another. These ends mount the assist frames 20, 21 for adjustments independently of the platform 12. Once the selected adjustment has been completed, the telescoping sections of the crossbar may be locked or clamped together to secure the adjusted positions.

It may be desirable at this time to place the user support on the platform 12 and adjust the cleats 32 against or adjacent to the user support legs or base to determine the relative positions of the upright leg parts 24 in relation to the support front. This is done to enable the user to sit on the support and assist in determining a comfortable position at which to locate the hand grips 28.

The upright leg parts 24 may be adjustably positioned toward or away from the support front and front edge 14 of the platform by releasing clamping pressure or releasing the pin from aligned adjustment holes between the crossbar ends 18, 19 and the respective brace parts 25. The uprights may be selectively adjusted, then locked into position in relation to the chair and user. Similar adjustments may be made at this time to select the desirable height of the hand grips 28.

Figure 7:
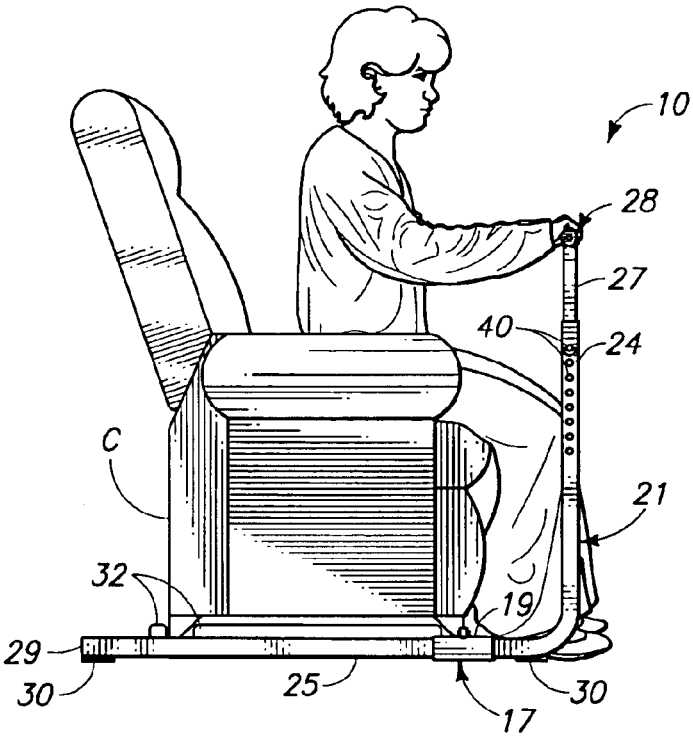
Figure 8:
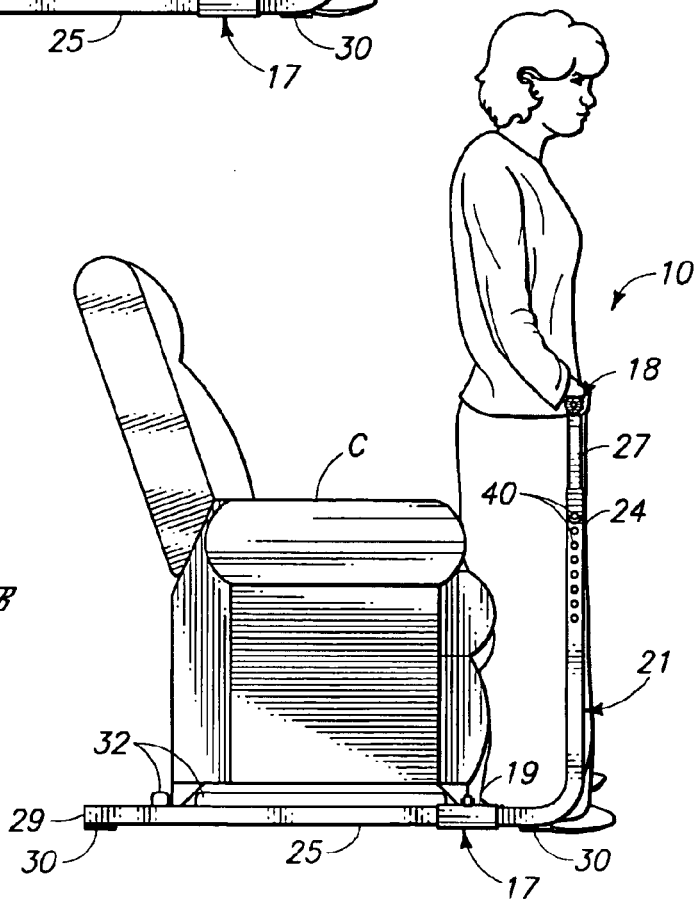
Figure 4:
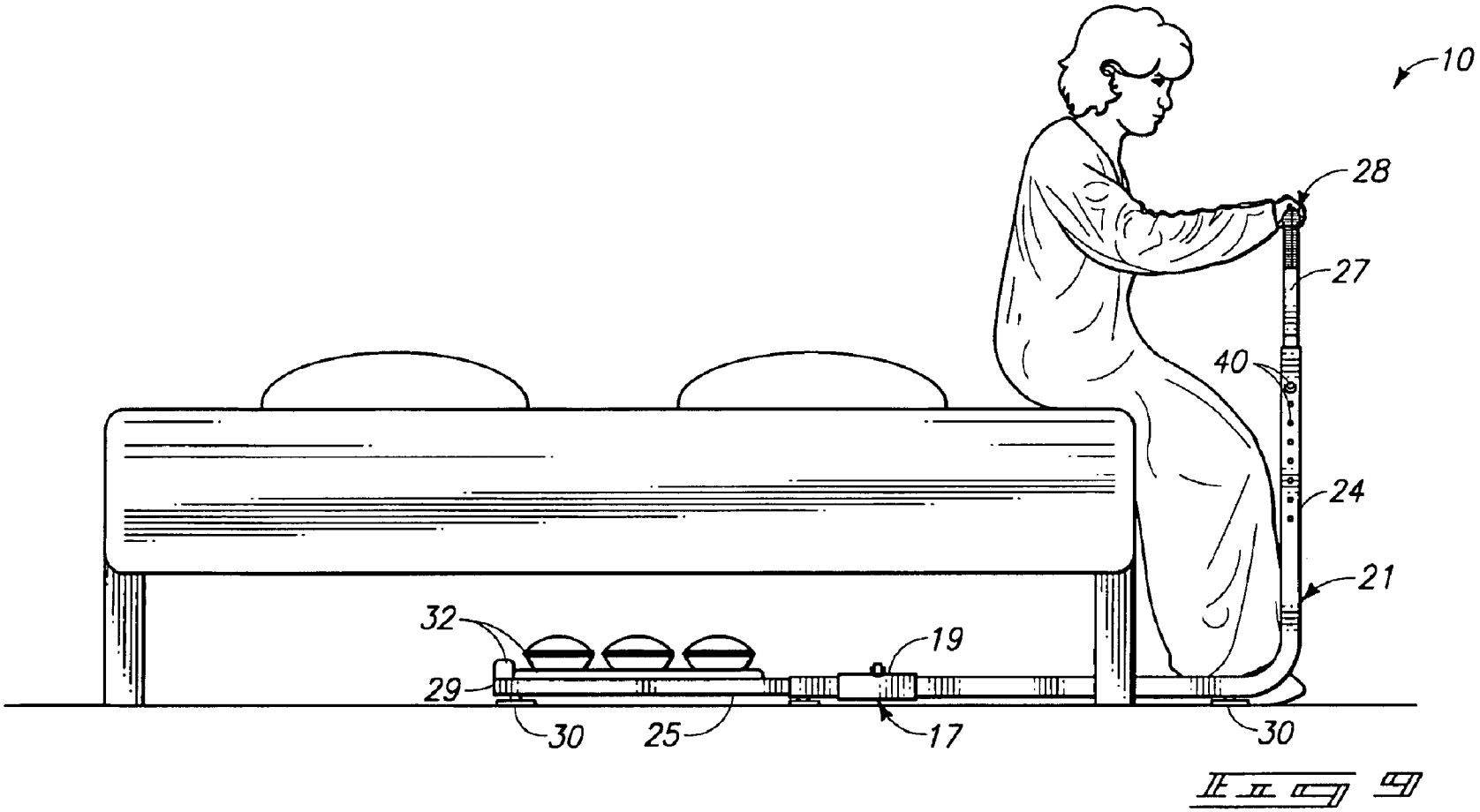

FIGS. 7 and 8 identify an individual properly positioned when the user support is a chair C. The user may grasp and pull against the hand grips 28 when moving to the standing position shown on FIG. 8. Conversely, a user attempting to sit may move from the standing position shown in FIG. 8 to the sitting position shown in FIG. 7 by also using the apparatus 10. Similar procedures may be employed when the support is a bed, as illustrated in FIG. 9.

Adjustments of the type described above may be made to accommodate both the user and the particular user support structure that is to be utilized. It should be noted that the user support need not be a recliner chair as illustrated, but may be other forms of user support taken in a broad context to include various other forms of furniture arrangements including sofas and beds.

While it is preferred that the apparatus be used in conjunction with seating arrangements in which the base portion of the user support be in engagement with or in close proximity to the platform 12; the platform 50 shown in FIG. 9 may be used along with added ballast to secure the device for use under a bed or similar structure.

It may be noted that the platform, raised parts 25, and crossbar 17 are all substantially coplanar. By this provision, a significant degree of latitude is provided to mount or receive a chair or other seating arrangement. Further, the adjustments provided to facilitate selective positioning of the assist frames together or apart allow the user to adapt the apparatus to various size user support arrangements such that the upright leg parts 24 may be spaced apart by a distance wider than that of the user support structure. This facilitates free access to the user support and enables use of the support as indicated in FIG. 2 if the selected support is a chair or a recliner. Similar adjustments may be made for chairs that have a swivel base.

It may be further noted that the area between the upright leg parts 24 is open and unobstructed. Further, the hand grips 28 are bent in an outward direction to free the access space between the upright leg parts. This facilitates safe and easy access to the area between the upright leg parts to facilitate safe and unencumbered access to the user support for rising and seating functions. Further, the bent transition between the upright leg parts and brace parts 24, 25 allow lateral access to the apparatus and user support without presenting any safety hazard as encountered with prior forms of assist apparatus where structure projects forwardly of the upright leg arrangements.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A sitting and standing assisting apparatus, comprising:

a platform having a user support receiving surface, a front edge and opposed side edges joined to the front edge;

a cross bar having plural cross bar ends, wherein the cross bar is mounted to the platform adjacent to the front edge and the cross bar ends are adjacent to the side edges;

"L" shaped assist frames mounted to the cross bar;

wherein each "L" shaped assist frame includes an upright leg part adjacent the cross bar, and a rearwardly extending brace part spaced outwardly of and extending along one of the side edges;

wherein the cross bar is adjustable to selectively space the assist frames apart from the platform side edges;

wherein the upright leg parts extend to upper ends that include hand grips;

wherein the platform is configured to receive the base of a user support with the assist frames selectively spaced apart and with the hand grips positioned to be grasped and acted against by a user seeking to sit or arise from the user support; and wherein the "L" shaped frames are adjustably mounted to the cross bar ends for selective forward and rearward adjustment of the upright leg parts with respect to the front edge of the platform.

2. The apparatus of claim 1 wherein the upright leg parts are adjustable to enable selective elevational positioning of the hand grips.

3. The apparatus of claim 1 wherein the hand grips are transverse to the upright leg parts.

4. The apparatus of claim 3 wherein the hand grips are integral with the upright leg parts and are bent outwardly with respect to the platform.

5. The apparatus of claim 1 wherein the platform includes user support engaging cleats.

6. The apparatus of claim 5 wherein the cleats are adjustably positionable on the platform.

7. The apparatus of claim 1 wherein the upright leg parts are spaced forwardly of the cross bar and platform front edge.

8. The apparatus of claim 1 wherein the user support receiving surface of the platform, the cross bar, and the rearwardly extending brace parts of the assist frames are substantially co-planar.

9. A sitting and standing assisting apparatus comprising:

a platform with an upwardly facing user support receiving surface and including a front edge and opposed side edges leading rearwardly from the front edge;

an adjustable cross-bar having plural cross-bar ends, wherein the cross-bar is mounted to the front edge of the platform and the cross-bar ends are spaced outwardly of the side edges;

wherein the cross bar is adjustable with respect to the platform such that the cross bar ends are selectively adjustable toward and away from the side edges;

"L" shaped assist frames, each having a horizontal brace part and an upright leg part;

wherein the leg parts extend to upper ends that include hand grips;

wherein the horizontal brace parts are attached to the cross bar ends and extend along the platform side edges rearwardly of the front edge;

wherein the horizontal brace parts are adjustably positionable with respect to the cross bar ends to permit selective forward and rearward positioning of the upright parts with respect to the front edge of the platform; and wherein the upright leg parts are adjustable to allow selective elevational positioning of the handgrips.

10. The apparatus of claim 9 wherein the hand grips are integral with the upright legs.

11. The apparatus of claim 10 wherein the hand grips are bent to include horizontal grip parts that are approximately parallel to the front edge of the platform and that lead in opposite directions away from one another.

12. The apparatus of claim 9 wherein the hand grips include upright grip parts and integral horizontal grip parts that lead in opposite directions away from one another.

13. The apparatus of claim 9 further comprising user supports engaging cleats adjustably positioned on the user support receiving surface, and wherein the cleats are approximately parallel to the side edges and are adjustable toward and away from the side edges.

14. The apparatus of claim 9 wherein the cross bar is spaced forward of the front edge of the platform and the horizontal brace parts are approximately parallel to and spaced outwardly from the side edges of the platform.

* * * * *

UNITED STATES PATENT AND TRADEMARK OFFICE

CERTIFICATE OF CORRECTION

PATENT NO. : 6,860,281 B1
DATED : March 1, 2005
INVENTOR(S) : Clift

It is certified that error appears in the above-identified patent and that said Letters Patent is hereby corrected as shown below:

Column 1,
Line 16, please delete “a” after “sitting”.
Line 17, please delete “in” after “without”.

Column 2,
Line 63, please delete “1B” after “ends” and insert -- 18 --.

Column 3,
Line 65, please delete “in” after “and”.

Column 4,
Line 24, please delete “support-surface” after “of the” and insert -- support surface --.
Line 49, please delete “1;2” after “platform” and insert -- 12 --.

Column 5,
Line 15, please delete “14” after “are not”.

Signed and Sealed this

Twenty-third Day of August, 2005

JON W. DUDAS
*Director of the United States Patent and Trademark Office*